US008426997B2

(12) United States Patent
Reagan

(10) Patent No.: US 8,426,997 B2
(45) Date of Patent: Apr. 23, 2013

(54) RESCUE AND EMERGENCY POWER METHOD AND SYSTEM

(76) Inventor: Lance Reagan, Charlotte, NC (US)

( * ) Notice: Subject to any disclaimer, the term of this patent is extended or adjusted under 35 U.S.C. 154(b) by 774 days.

(21) Appl. No.: 12/607,504

(22) Filed: Oct. 28, 2009

(65) Prior Publication Data

US 2011/0095533 A1 Apr. 28, 2011

(51) Int. Cl.
*F03B 13/00* (2006.01)

(52) U.S. Cl.
USPC ..... 290/54

(58) Field of Classification Search ..... 290/43, 290/54
See application file for complete search history.

(56) References Cited

U.S. PATENT DOCUMENTS

| | | | | |
|---|---|---|---|---|
| 4,122,381 | A * | 10/1978 | Sturm | 320/128 |
| 4,246,753 | A * | 1/1981 | Redmond | 60/398 |
| 4,352,025 | A * | 9/1982 | Troyen | 290/54 |
| 6,464,043 | B2 * | 10/2002 | Wang | 187/314 |
| 7,579,701 | B1 * | 8/2009 | White | 290/43 |
| 8,129,855 | B1 * | 3/2012 | Tong et al. | 290/54 |
| 2006/0055173 | A1 * | 3/2006 | Gianfranco | 290/1 B |
| 2006/0108808 | A1 * | 5/2006 | Chen | 290/54 |
| 2008/0246282 | A1 * | 10/2008 | Hathaway et al. | 290/54 |
| 2009/0014250 | A1 * | 1/2009 | Jang | 187/257 |
| 2009/0058092 | A1 * | 3/2009 | Chen | 290/54 |
| 2009/0090434 | A1 * | 4/2009 | Brand et al. | 144/334 |
| 2009/0090880 | A1 * | 4/2009 | Dolenti et al. | 251/129.03 |
| 2009/0095339 | A1 * | 4/2009 | Nightingale | 136/244 |
| 2011/0133467 | A1 * | 6/2011 | Stiles | 290/55 |
| 2011/0304147 | A1 * | 12/2011 | Ho | 290/54 |

FOREIGN PATENT DOCUMENTS

JP 09047523 A * 2/1997

* cited by examiner

*Primary Examiner* — Tulsidas C Patel
*Assistant Examiner* — Viet Nguyen
(74) *Attorney, Agent, or Firm* — Clements Bernard PLLC; Seth L. Hudson

(57) ABSTRACT

The present invention provides methods and systems for a power generation system, including an inlet for introducing a liquid into the system, an inlet pipe for carrying the liquid introduced to the inlet, a generation station for converting the flow of liquid into energy, and an outlet pipe for removing the liquid from the generation station.

3 Claims, 4 Drawing Sheets

RESCUE AND EMERGENCY POWER METHOD AND SYSTEM

FIELD OF THE INVENTION

The present invention relates generally to a system and method for generating power from a high pressure, condensed water source, and more generally is a system and method for generating power utilizing water pumped from a pumper truck for providing power to activate building systems that aid in the fighting of fires in a building and potentially safe lives.

BACKGROUND OF THE INVENTION

Firefighters are heroic individuals who risk their lives every day for the common good. As regular ordinary citizens are fleeing a building because of a fire, the firefighters are rushing into the building. Fighting fires in a high rise or multistory building can be particularly challenging. When a fire occurs on a top floor of these buildings, firefighters have to travel to these floors in order to fight the fire. Very often this means the firefighter must climb numerous stairs to reach the fire, because the use of the elevator during a power outage would create a potentially treacherous and hazardous situation. The present invention is designed provide energy that is not contingent upon the power associated with the building. The present invention will continue to supply power even if the power to the main building is shut-off or compromised.

BRIEF SUMMARY OF THE INVENTION

According to a preferred embodiment of the present invention, a power generation system including an inlet for introducing a liquid into the system, an inlet pipe for carrying the liquid introduced to the inlet, a generation station for converting the flow of liquid into energy, and an outlet pipe for removing the liquid from the generation station.

According to another preferred embodiment of the present invention, the power generation system uses water as the liquid.

According to yet another preferred embodiment of the present invention, the power generation system includes a drive shaft engaged to the generation station.

According to yet another preferred embodiment of the present invention, the power generation system includes a clutch engaged to the drive shaft.

According to yet another preferred embodiment of the present invention, the power generation system includes a turbine for generating energy in the generation station.

According to yet another preferred embodiment of the present invention, the power generation system includes a gear box comprising a bevel gear set.

According to yet another preferred embodiment of the present invention, the power generation system includes a drive shaft that rotates a first gear, wherein the first gear is engaged to a second gear for driving a drive shaft.

According to yet another preferred embodiment of the present invention, the power generation system includes a pump for pumping water, an inlet for receiving water from the pump, an inlet pipe for carrying the water pumped into system by the pump, a generation station that receives the water from the inlet pipe, a turbine housed within the generation station for converting the flow of the water to energy, and an outlet pipe for removing the liquid from the generation station.

According to yet another preferred embodiment of the present invention, the power generation system includes a generator for producing electrical energy from the rotational energy of the turbine.

According to yet another preferred embodiment of the present invention, the power generation system includes a pumper truck as the pump.

According to yet another preferred embodiment of the present invention, the power generation system includes a hose for forming a connection between the pump and the inlet.

According to yet another preferred embodiment of the present invention, the power generation system includes a clutch operated by a solenoid control for engaging and disengaging the clutch.

According to yet another preferred embodiment of the present invention, the power generation system includes a drive shaft that is rotated by the generation station and a clutch engaged to one end of the drive shaft for engaging and disengaging the drive shaft from a power shaft, wherein the power shaft in engaged to the sheave of an elevator for operating the elevator.

According to yet another preferred embodiment of the present invention, the power generation system includes a solenoid control having a indicator, whereby the solenoid control controls a clutch and the indicator indicates a predetermined rpm of the clutch.

According to yet another preferred embodiment of the present invention, the power generation system includes providing an inlet, an inlet pipe, a generation station, and an outlet pipe, introducing water into the inlet, carrying the water through the inlet pipe and into the generation station, producing energy from the flow of water into the generation station, and discharging the water from the outlet pipe.

According to yet another preferred embodiment of the present invention, the power generation system includes providing a pump for introducing the water into the inlet.

According to yet another preferred embodiment of the present invention, the power generation system includes providing a drive shaft and a power shaft, wherein the energy produced by the generation station drives the drive shaft which in turn drives the power shaft.

According to yet another preferred embodiment of the present invention, the power generation system includes providing a pumper truck for pumping water into the inlet.

According to yet another preferred embodiment of the present invention, the power generation system includes an elevator sheave and providing energy from the generation station to the sheave.

According to yet another preferred embodiment of the present invention, the power generation system includes providing a power shaft for providing rotational movement to power a fan.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
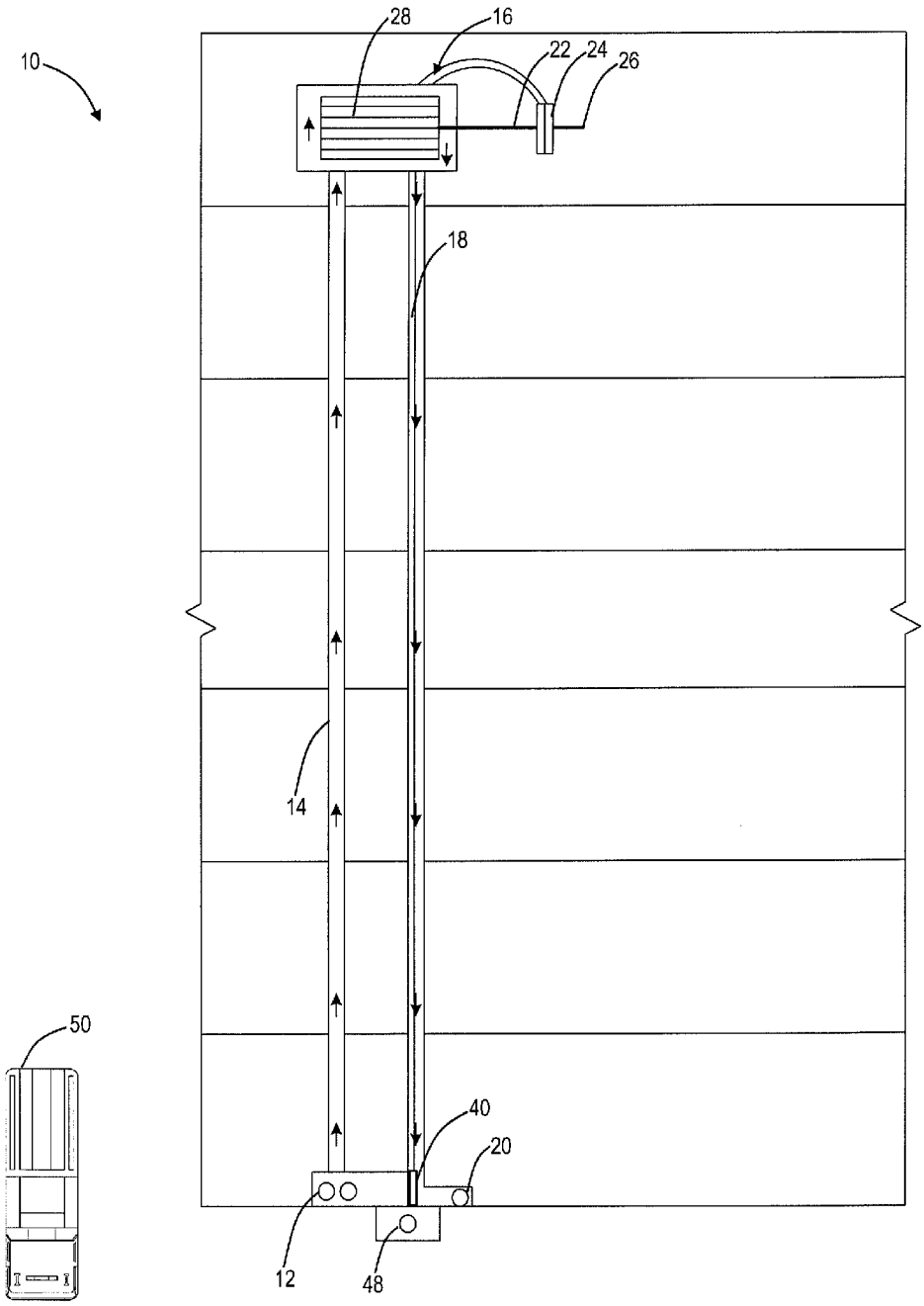
FIG. 1 is a perspective view of the novel system and method for generating power utilizing pressurized water in a building.

Referring now specifically to the drawings, a power generation system and method according to a preferred embodiment of the present invention is illustrated in FIG. 1 and is shown generally at reference numeral 10. The power generation system 10 generally comprises a water inlet 12, an inlet pipe 14, energy generation station 16, an outlet pipe 18, and a water outlet 20. The water inlet 12 may be any water inlet known to one of ordinary skill in the art, including a Fire Department Connection(s) (FDC) point exterior of a building. FDCs are commonly utilized by the fire department to add water supply to the fire suppressant piping in a building that supplies water to the sprinklers. The present invention would not increase the water supply to the sprinklers, but would consist of a water inlet 12 located in close proximity to the standard FDC and utilizing a connection similar to that employed by an FDC.

The inlet pipe 14 transports water, or other suitable liquid, from the water inlet 12 to the energy generation station 16. The energy generation station 16 may produce electrical energy or mechanical power, depending upon the configuration of the energy generation station 16 as described in more detail below. The inlet pipe 14 consists of any material that is suitable to transport water, or other suitable liquid, from one location to another based upon the desires of the user. Preferably, the inlet pipe 14 is composed of mild steel with an anticorrosive coating; however, it should be noted that any material capable of transporting pressurized water may be utilized, including but not limited to, polyvinyl chloride (PVC/uPVC), ductile iron, polyethylene, copper, concrete, stainless steel, and galvanized steel. The inlet pipe 14 transports water from the water inlet 12 to the energy generation station 16.

The energy generation station 16 consists of a water turbine and generator 28. The water turbine contains blades, and the inlet pipe 14 deposits water onto the blades, creating a force on the blades. The shape of the turbine blades is determined by the pressure of the water entering the generation station 16 from the water inlet 14. Generally, the water exits the inlet pipe 14 and the blades of the turbine are impelled by the water flowing through the turbine. As is well known in the art, the generator converts the mechanical energy produced by the flowing water impelling the blades, converting the mechanical energy to electrical energy. As is well known in the art, the blades are engaged to a turbine-generator shaft. The rotational movement of the blades causes the turbine-generator shaft to rotate. The turbine-generator shaft is engaged to a rotor that also rotates when the turbine-generator shaft rotates. The rotor rotates around a stationary stator, thus producing an electrical current. The electrical current is then used to power a number of devices as set forth in more detail below.

In another alternative embodiment, the energy generation station 16 consists of blades 28 within a housing for providing mechanical power. As the water exits the inlet pipe 14, the blades 28 are impelled by the water, thus causing the blades 28 to rotate. The blades 28 are attached to a drive shaft 22 that rotates at the same rotational velocity as the blades 28. In other words, as the blades 28 rotate, the rotational movement of the blades 28 drives the drive shaft 22. A clutch 24 is disposed between the drive shaft 22 and power shaft 26. The end of the power shaft 26 may be engaged to a device for supplying rotational movement. A flywheel (not shown) stores kinetic energy and aids in reducing speed variation caused by load variations. The flywheel stores the kinetic energy and aids in reducing speed variations caused by load variations. The type of flywheel utilized will be determined by the desires of the user.

The clutch 24 is engaged and disengaged by a piston 40. The piston 40, may be powered by a solenoid control 48, which drives the piston 40, thus engaging and disengaging the clutch 24. In one alternative embodiment, the piston is positioned within the water outlet pipe 18. However, the piston 40 may be positioned in any arrangement suitable for engaging and disengaging the clutch 24. The solenoid control 48 may be any device capable of moving the piston 40 in a vertical direction to engage and disengage the clutch 24.

After the water has impeded the blades, the water exits the energy generation station 16 through an outlet pipe 18. The outlet pipe 18 consists of any material that is suitable to transport water, or other suitable liquid, from one location to another based upon the desires of the user. Preferably, the outlet pipe 18 is composed of the same material as the inlet pipe 14. The outlet pipe 18 may be composed of mild steel with an anticorrosive coating; however, it should be noted that any material capable of transporting pressurized water may be utilized, including but not limited to polyvinyl chloride (PVC/uPVC), ductile iron, polyethylene, copper, concrete, stainless steel, and galvanized steel. The outlet pipe 18 transports water from the energy generation station 16.

Figure 2:
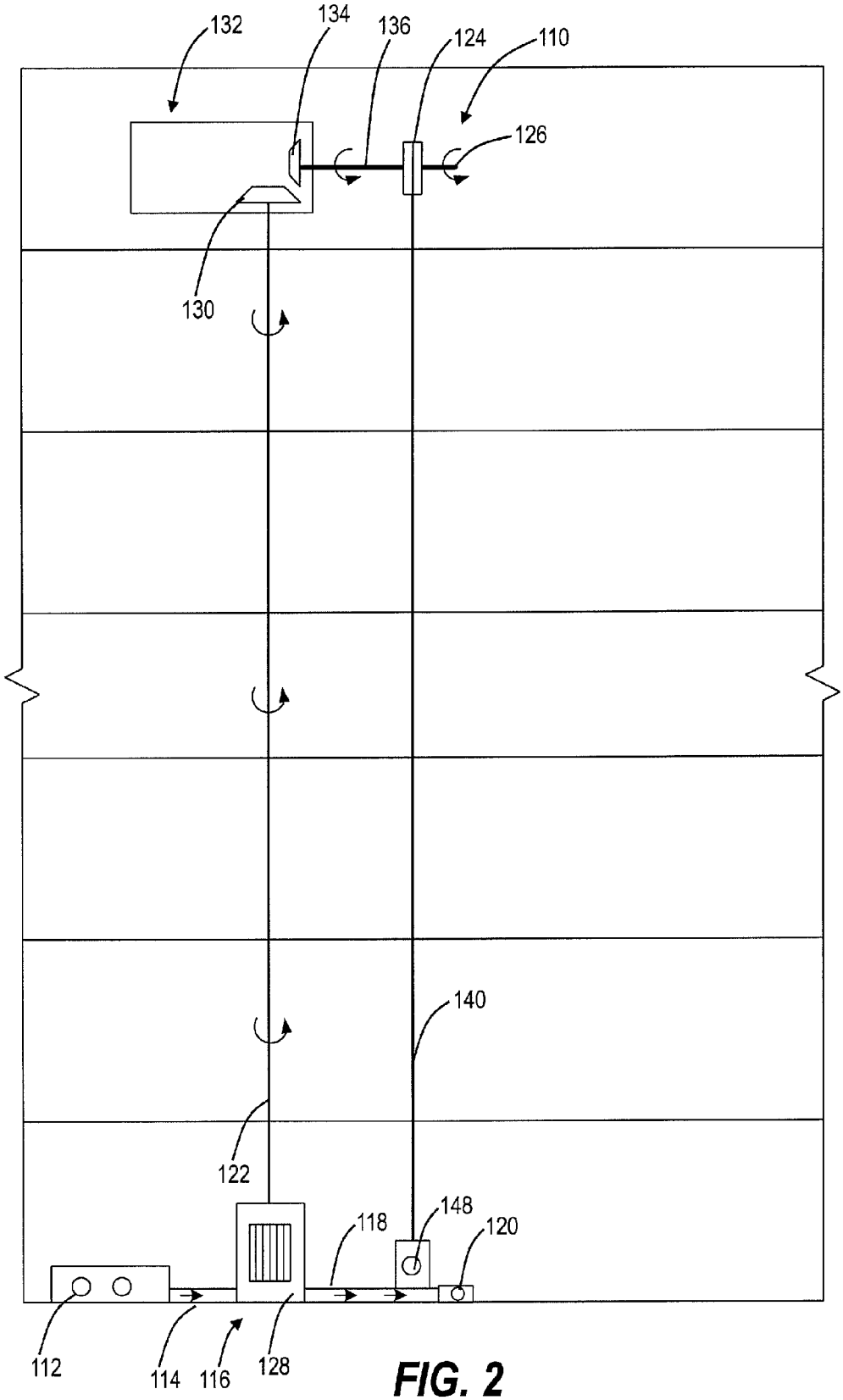
FIG. 2 is a perspective view of an exemplary embodiment of the novel system and method for generating power utilizing pressurized water in a building.

In another exemplary embodiment of the present invention as illustrated in FIG. 2, the power generation system 110 generally comprises a water inlet 112, an inlet pipe 114, energy generation station 116, an outlet pipe 118, and a water outlet 120. The inlet pipe 114 transports water, or other suitable liquid, from the water inlet 112 to the energy generation station 116. The energy generation station 116 consists of a water turbine and generator. The water turbine contains blades, and the inlet pipe 114 deposits water onto the blades, creating a force on the blades. The shape of the turbine blades is determined by the pressure of the water entering the generation station 116 from the water inlet 114. Generally, the water exits the inlet pipe 114 and the blades of the turbine are impelled by the water flowing through the turbine. As is well known in the art, the generator converts the mechanical energy produced by the flowing water impelling the blades, converting the mechanical energy to electrical energy. As is well known in the art, the blades are engaged to a turbine-generator shaft. The rotational movement of the blades causes the turbine-generator shaft to rotate. The turbine-generator shaft is engaged to a rotor that also rotates when the turbine-generator shaft rotates. The rotor rotates around a stationary stator, thus producing an electrical current. The electrical current is then used to provide power to drive the drive shaft 122.

In another alternative embodiment, the energy generation station 116 consists of blades within a housing for providing mechanical power. As the water exits the inlet pipe 114, the blades are impelled by the water, thus causing the blades to rotate. The blades are attached to a drive shaft 122 that rotates at the same rotational velocity as the blades. In other words, as the blades rotate, the rotational movement of the blades drive the drive shaft 122. A clutch 124 is disposed between the drive shaft 122 and power shaft 126. A flywheel (not shown) which stores kinetic energy and aids in reducing speed variation caused by load variations may be engaged to the drive shaft 122. The flywheel stores the kinetic energy and aids in reducing speed variations caused by load variations. The type of flywheel utilized will be determined by the desires of the user.

The drive shaft 122, as illustrated in FIG. 2, is engaged to a first gear 130 optionally positioned within a gear box 132. The first gear 130 is engaged to a second gear 134. The second gear 134 drives a second drive shaft 136. The angle between the drive shaft 122 and second drive shaft 136 is about 90°; therefore, the first gear 130 and second gear 134 may be helical gears or a wormset. The angles between the axes of the cones of the gears and the included angles of the cones can be any compatable value as long as the apices of the cones intersect. Failure of the apices of the cones to intersect would cause a mismatch of velocity at the interface. The apex of each gear cone has a zero radius, thus zero velocity. All other points on the gear cone will have a nonzero velocity. If a bevel gear is utilized, the velocity ratio of the bevel gears is defined by the following equation:

$$VR = \frac{\omega out}{\omega in} = \pm \frac{rin}{rout}$$

A straight bevel gear may be utilized, wherein the teeth are parallel to the axis of the gear. Alternatively, a spiral bevel gear may be utilized, wherein the teeth are angled with respect to the axis of the gear. In any event, the cone axes must intersect in both cases.

The first gear 130 drives the second gear 134, which in return rotates the second drive shaft 136. A clutch 124 is disposed between the drive shaft 122 and a power shaft 126. The end of the power shaft 126 may be engaged to a device for supplying rotational movement. A flywheel (not shown) stores kinetic energy and aids in reducing speed variation caused by load variations. The type of flywheel utilized will be determined by the desires of the user.

The clutch 124 is engaged and disengaged by a piston 140. The piston 140, may be powered by a solenoid control 148, which drives the piston 140, thus engaging and disengaging the clutch 124. In one alternative embodiment, the piston is positioned within the water outlet pipe 118. However, the piston 140 may be positioned in any arrangement suitable for engaging and disengaging the clutch 124.

After the water exits the energy generation station 116 through the outlet pipe 118. The outlet pipe 118 consists of any material that is suitable to transport water, or other suitable liquid, from one location to another based upon the desires of the user. Preferably, the outlet pipe 118 is composed of the same material as the inlet pipe 114. The outlet pipe 118 may be composed of mild steel with an anticorrosive coating; however, it should be noted that any material capable of transporting pressurized water may be utilized, including but not limited to polyvinyl chloride (PVC/uPVC), ductile iron, polyethylene, copper, concrete, stainless steel, and galvanized steel. The outlet pipe 118 transports water from the energy generation station 116.

Figure 3:
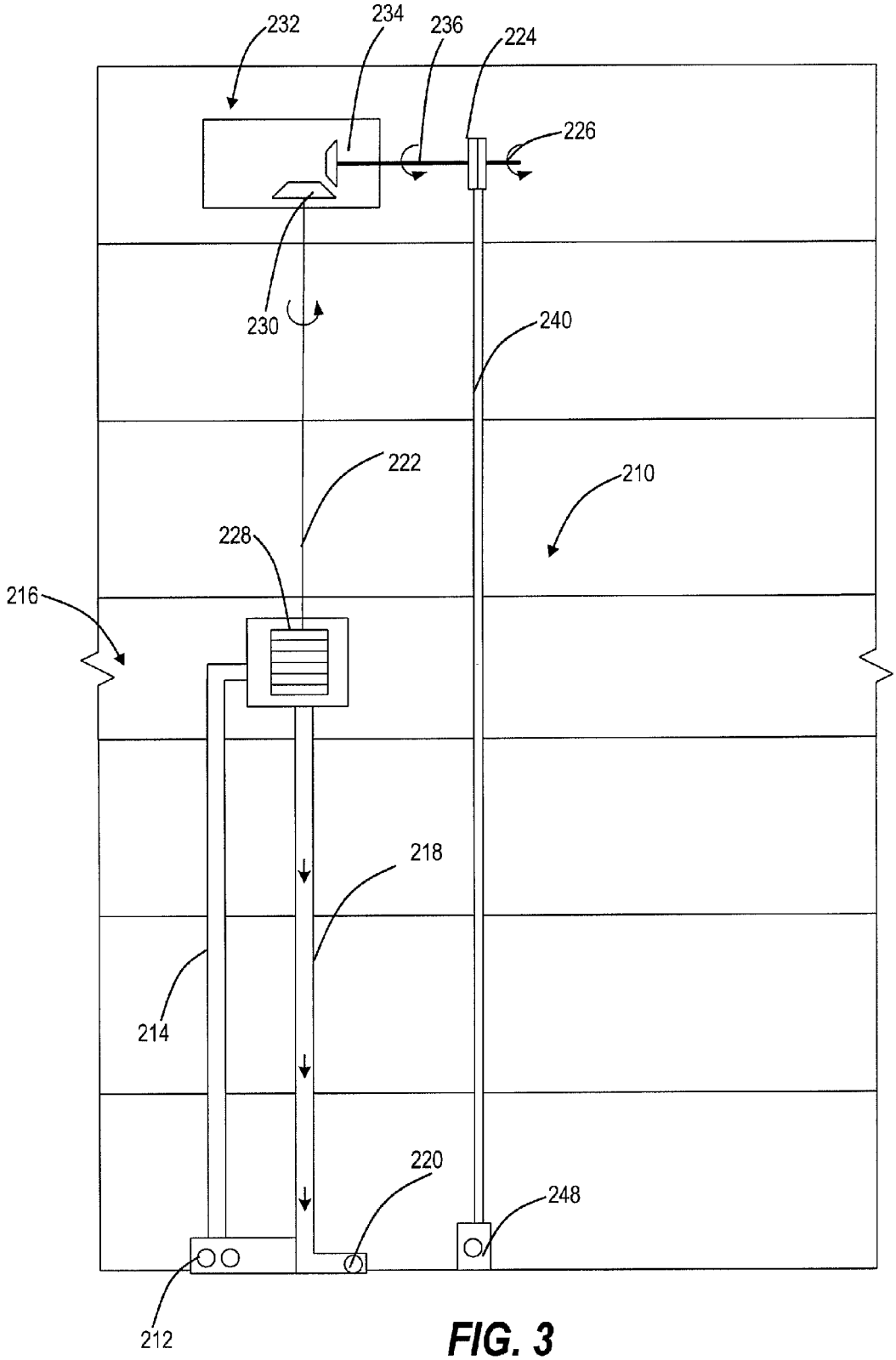
FIG. 3 is a perspective view of another exemplary embodiment of the novel system and method for generating power utilizing pressurized water in a building.

In another alternative embodiment, as illustrated in FIG. 3, the inlet pipe 214 transports water, or other suitable liquid, from the water inlet 212 to the energy generation station 216. The inlet pipe 214 consists of any material that is suitable to transport water, or other suitable liquid, from one location to another based upon the desires of the user. Preferably, the inlet pipe 214 is composed of mild steel with an anticorrosive coating; however, it should be noted that any material capable of transporting pressurized water may be utilized, including but not limited to polyvinyl chloride (PVC/uPVC), ductile iron, polyethylene, copper, concrete, stainless steel, and galvanized steel. The inlet pipe 214 transports water from the water inlet 212 to the energy generation station 216.

In another alternative embodiment, the energy generation station 216 consists of blades 228 within a housing. As the water exits the inlet pipe 214, the blades 228 are impelled by the water, thus causing the blades 228 to rotate. The blades 228 are attached to a first drive shaft 222 that rotates at the same rotational velocity as the blades 228. In other words, as the blades 228 rotate, the rotational movement of the blades 228 drives the drive shaft 222.

The first drive shaft 222, as illustrated in FIG. 3, is engaged to a first gear 230 optionally positioned within a gear box 232. The first gear 230 is engaged to a second gear 234. The second gear 234 drives a second drive shaft 236. The angle between the drive shaft 222 and second drive shaft 236 is about 90°; therefore, the first gear 230 and second gear 234 may be helical gears or a wormset housed within a gear box 232. The first gear 230 drives the second gear 234, which in return rotates the second drive shaft 236. A clutch 224 is disposed between the second drive shaft 234 and a power shaft 226. The end of the power shaft 226 may be engaged to a device for supplying rotational movement. A flywheel (not shown) stores kinetic energy and aids in reducing speed variation caused by load variations. The type of flywheel utilized will be determined by the desires of the user.

The clutch 224 is engaged and disengaged by a piston 240. The piston 240, may be powered by a solenoid control, which drives the piston 240, thus engaging and disengaging the clutch 224. In one alternative embodiment, the piston is positioned within the water outlet pipe 218. However, the piston 240 may be positioned in any arrangement suitable for engaging and disengaging the clutch 224.

The water exits the energy generation station 216 through an outlet pipe 218. The outlet pipe 218 consists of any material that is suitable to transport water, or other suitable liquid, from one location to another based upon the desires of the user. Preferably, the outlet pipe 218 is composed of the same material as the inlet pipe 214. The outlet pipe 218 may be composed of mild steel with an anticorrosive coating; however, it should be noted that any material capable of transporting pressurized water may be utilized, including but not limited to polyvinyl chloride (PVC/uPVC), ductile iron, polyethylene, copper, concrete, stainless steel, and galvanized steel. The outlet pipe 218 transports water from the energy generation station 216 that is discharged through the water outlet 220.

Figure 4:
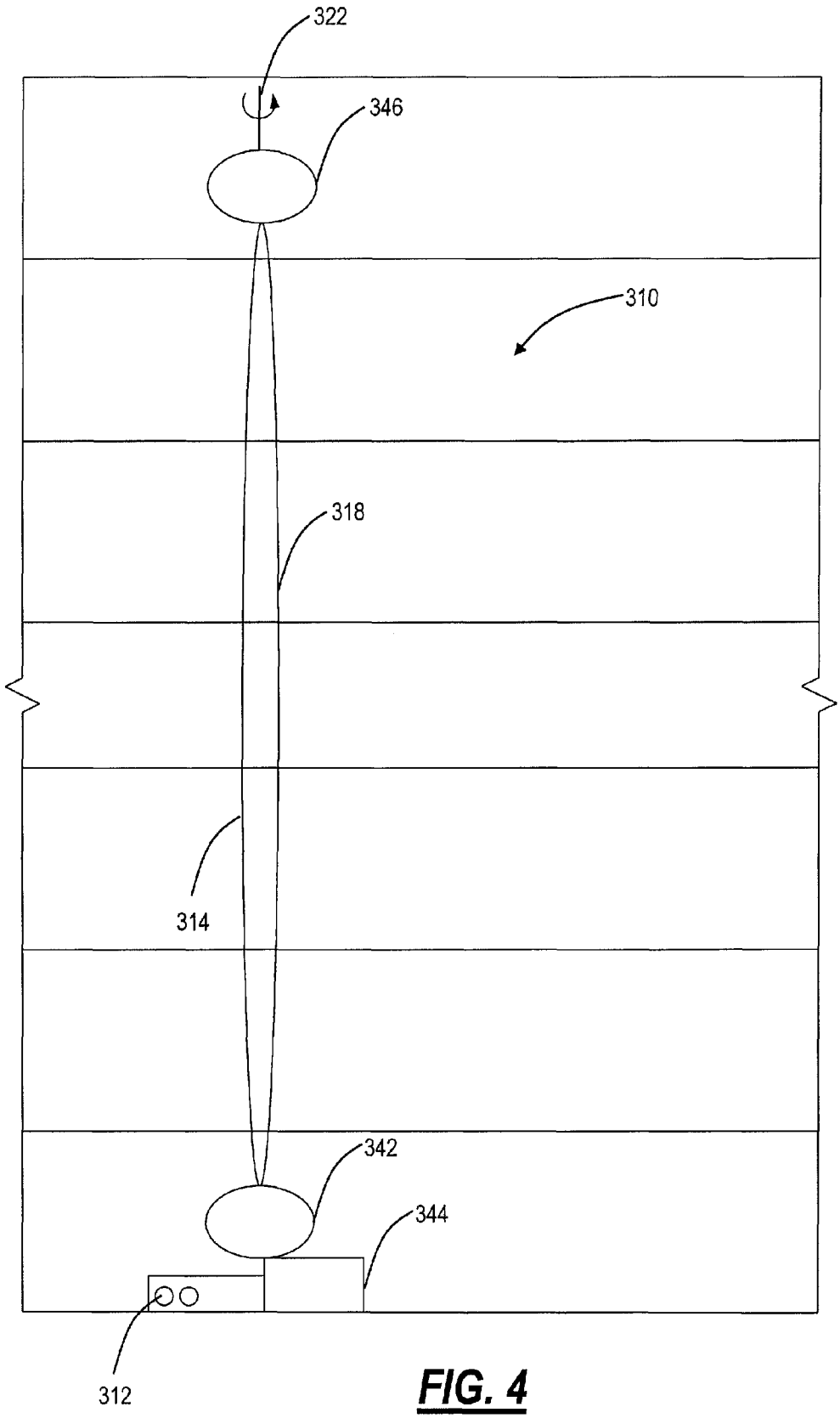
FIG. 4 is a perspective view of another exemplary embodiment of the novel system and method for generating power utilizing pressurized water in a building.

In yet another exemplary embodiment of the present invention, as illustrated in FIG. 4, water is pumped into a water inlet 312 and into a first water vane 342. A motor 344 rotates the water vane 342, which forces water through an inlet pipe 314. A second water vane 346 is positioned on the exit end of the inlet pipe 314. The force of the water engaging the second water vane 346 causes the water vane to rotate a drive shaft 322. The rotational movement of the drive shaft 322 may drive a number of components as described below. After the water engages the second water vane 346, the water enters an outlet pipe 318. The inlet pipe 314 and outlet pipe 318 consists of any material that is suitable to transport water, or other suitable liquid, from one location to another based upon the desires of the user. Preferably, the outlet pipe 318 is composed of the same material as the inlet pipe 314. The outlet pipe 318 may be composed of mild steel with an anticorrosive coating; however, it should be noted that any material capable of transporting pressurized water may be utilized, including but not limited to polyvinyl chloride (PVC/uPVC), ductile iron, polyethylene, copper, concrete, stainless steel, and galvanized steel.

During use, the systems and methods described above may be used in a number of applications. One application includes the operation of an elevator during a fire to aid firefighters and save the lives of occupants of the building. When a fire occurs, the elevators in a building are designed to cease operation. While firefighters may override this shutoff, it is potentially dangerous for firefighters to use the elevators during a fire because of the very possible risk of an electrical outage, causing the elevator to become inoperable. In lieu of using the elevator as transportation, the firefighters must climb the steps to reach the floors. This is both time consuming and physically exhausting. One use of the present invention is to provide power to an elevator so the elevator may be utilized during a fire-nothwithstanding the threat of an electrical outage.

In this exemplary embodiment, a pumper truck 50 is utilized to pump water into the water inlet (12, 112, 212, 312). The pumper truck 50 is connected to a fire hydrant and the pumper truck 50 forces the water into the water inlet (12, 112, 212, 312) of the system (10, 110, 210, 310). Preferably, the water inlet (12, 112, 212, 312) is located on the same panel as the FDC. Preferably, the panel will read "FDC REEPS 450 psi." "REEPS" stands for Rescue and Emergency Elevator Power Systems. The term REEPS would convey to the firefighters arriving at the scene of the fire to understand that the building is equipped with a REEPS system as disclosed herein and the elevator may be safely operated after the pumper truck 50 is engaged to the water inlet (12, 112, 212, 312). The pressure of the REEPS system would also be indicated on the sign to convey to the firefighters the pressure needed to run the REEPS system. The REEPS system may use a 2½ or 3 inch connection on the exterior of a building.

The outlet pipe (18, 118, 218, 318) may discharge the water onto the ground or into a drain external of the building. However, the outlet pipe (18, 118, 218, 318) may return the water to the pumper truck 50 to be recirculated to the REEPS system. The building would include a discharge connection or fitting for allowing a hose to connect the connection to the pumper truck 50. The pumper truck utilizes a centrifugal pump or the like, which allows the water exiting the outlet pipe (18, 118, 218, 318) to be recirculated. A gated Y valve may be engaged to the outlet pipe (18, 118, 218, 318), so that if the water overheats and is too hot it can be flushed from the system.

The inlet pipe (12, 112, 212, 312) and outlet pipe (18, 118, 218, 318) may be located internal or external to a building. Preferably, the inlet pipe (12, 112, 212, 312) and outlet pipe (18, 118, 218, 318) are located internal of the building for protecting the pipes from the elements. The inlet pipe (12, 112, 212, 312) and outlet pipe (18, 118, 218, 318) may be located anywhere in the building, including within the elevator shaft of the building. The generation station (16, 116, 216) may be located within the machine room. The power generated by the generation station (16, 116, 216) may be used to provide electrical power to the electrical motor of the elevator. Alternatively, the rotational movement of the power shaft (26, 126, 226) may rotate the motor, sheave or like device to power the elevator. As is well known, the sheave is the pulley like device that receives the hoist ropes of the elevator and the rotational movement of the sheave raises and lowers the elevator car.

The benefit of this system is that water is being utilized to power the elevator, which is not subject to the same limitations as electricity during a fire. The firefighters may utilize the elevator safely and efficiently without a concern of a power outage caused by the fire. The operation of the elevator based upon the flow of water through the inlet pipe (12, 112, 212, 312), generation station (16, 116, 216), and outlet pipe (18, 118, 218, 318) is not subject to the limitations of an electrical current flowing through the building. In fact, the user of water for the generation of electricity or power to run the elevator will provide continuous power and electricity and will not be affected by a fire.

The REEPS system allows a firefighter to reach a floor utilizing the elevator without having to expend effort climbing multiple steps. Fire equipment may be transported to the fire and surrounding floors by use of the elevator. Further, the elevator may be utilized to transport injured or handicapped occupants of the building to safety.

Instead of or in addition to providing power or electricity to activate the elevator, the power or energy may be utilized to include a fan that may be engaged to the ventilation system of the building to provide ventilation even though the power to the building has been compromised. The fan would be a direct drive to the energy generation station 16 without the need for electricity. In another embodiment, the power or electricity supplied by the generation station (16, 116, 216) may be engaged to a generator for supplying power. In yet another embodiment, the electricity may be utilized to supply power to a winch that is located on the top of a building. The winch would be operated to carry supplies (hoses, axes, medical equipment, etc.) utilized by a firefighter to the top of the building. Alternatively, the rotational power of the power shaft (26, 126, 226) may be used to drive the winch. In yet another embodiment, the electricity supplied may be made available for any such uses by an electrical connector. The electrical connector would allow a standard electrical cord having a male end to be inserted into the electrical connector for providing power to a myriad of devices.

A solenoid control (48, 148, 248) may be positioned on the exterior of the building for operating the clutch (24, 124, 224). The solenoid control (48, 148, 248) may include an indicator, such as a light, to indicate a desired rpm has been achieved by the power shaft (26, 126, 226), allowing the operator to engage and disengage the clutch (24, 124, 224). Preferably, the solenoid switch (48, 148, 248) consists of a horizontal chamber for receiving pressurized liquid. A piston chamber intersects the horizontal chamber allowing the pressurized liquid to enter the piston chamber. The piston chamber is configured to receive the piston (40, 140, 240). As the pressurized liquid enters the horizontal chamber, the pressurized liquid exerts pressure on the piston (40, 140, 240), thus forcing the piston upward (allowing the pressurized liquid to fill the void left by the upward movement of the piston) and operatively engaging the clutch (24, 124, 224). When the flow of pressurized liquid is ceased, the pressurized liquid exits the piston chamber, thus allowing the piston (40, 140, 240) to return to its original position within the piston chamber and as a result the clutch (24, 124, 224) is disengaged.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A rescue and emergency system, comprising:

an inlet positioned on the exterior of a building for receiving water;

a pumper truck that is engaged to a fire hydrant, whereby the pumper truck pumps water into the inlet;

an inlet pipe for carrying the water pumped into the system;

a generation station positioned within the interior of the building that receives the water from the inlet pipe, the generation station comprises blades attached to a first drive shaft that is enclosed by a housing;

a first gear engaged to the first drive shaft;

a second gear engaged to a second drive shaft, whereby the first gear and second gear are engaged to one another;

a clutch disposed between the second drive shaft and a power shaft, and an outlet pipe for removing the liquid from the generation station.

2. The rescue and emergency system according to claim 1, further comprising a hose for forming a connection between the pump and the inlet.

3. The rescue and emergency system according to claim 1, further comprising a solenoid control having an indicator, whereby the solenoid control controls a clutch and the indicator indicates a predetermined rpm of the clutch.

* * * * *